US009359114B2

(12) United States Patent
Wong

(10) Patent No.: US 9,359,114 B2
(45) Date of Patent: Jun. 7, 2016

(54) DETACHABLE SEALABLE LID, CONTAINER COMPRISING THE SAME AND SEALING RING FOR USE WITH THE LID

(71) Applicant: Siu Wah Wong, Hong Kong (HK)

(72) Inventor: Siu Wah Wong, Hong Kong (HK)

(73) Assignee: King's Flair Development Ltd., Hong Kong (HK)

( * ) Notice: Subject to any disclaimer, the term of this patent is extended or adjusted under 35 U.S.C. 154(b) by 0 days.

(21) Appl. No.: 14/210,822

(22) Filed: Mar. 14, 2014

(65) Prior Publication Data

US 2014/0284333 A1 Sep. 25, 2014

Related U.S. Application Data

(60) Provisional application No. 61/804,260, filed on Mar. 22, 2013.

(51) Int. Cl.

| | |
|---|---|
| ***B65D 53/02*** | (2006.01) |
| ***B65D 43/26*** | (2006.01) |
| ***B65D 39/12*** | (2006.01) |
| ***B65D 45/32*** | (2006.01) |

(52) U.S. Cl.

CPC ..... *B65D 43/26* (2013.01); *B65D 39/12* (2013.01); *B65D 45/327* (2013.01); *B65D 2543/00564* (2013.01); *B65D 2543/00972* (2013.01)

(58) Field of Classification Search

CPC ..... B65D 2543/00564; B65D 2543/00972; B65D 53/02; B65D 39/12; B65D 43/26; B65D 45/237; F16L 55/132; F01M 11/0408

USPC ..... 220/233–238, 378, 804; 215/358–361

See application file for complete search history.

(56) References Cited

U.S. PATENT DOCUMENTS

| | | | | |
|---|---|---|---|---|
| 5,044,403 | A * | 9/1991 | Chen | 138/89 |
| 2004/0245251 | A1* | 12/2004 | Heng et al. | 220/234 |
| 2007/0241107 | A1* | 10/2007 | Matsumoto et al. | 220/238 |
| 2008/0041869 | A1* | 2/2008 | Backaert | 220/804 |
| 2008/0179274 | A1* | 7/2008 | Cheng | 215/329 |
| 2012/0285958 | A1* | 11/2012 | Lee | 220/235 |
| 2013/0037540 | A1* | 2/2013 | Sze | 220/237 |

* cited by examiner

*Primary Examiner* — James N Smalley
(74) *Attorney, Agent, or Firm* — Nyemaster Goode, P.C.

(57) ABSTRACT

The present invention relates to a lid for a container, which lid is capable of sealing and being removed from the container through simply rotating a handle mounted on the lid. The lid comprises two parts to provide the ease of cleaning of the lid. The two parts of the lid can be conveniently disassembled by pushing at least one locking plate provided on the lid, and can be easily re-assembled. The present invention also provides a sealing ring which provides better sealing effect and easier mounting. A container comprising the sealable lid and the sealing ring is also provided.

21 Claims, 12 Drawing Sheets

DETACHABLE SEALABLE LID, CONTAINER COMPRISING THE SAME AND SEALING RING FOR USE WITH THE LID

RELATED APPLICATION

This non-provisional application claims priority from provisional application no. 61/804,260 filed on Mar. 22, 2013, the disclosures of which are incorporated herein by reference in their entirety.

TECHNICAL FIELD

The present invention relates to the field of lids for containers. More specifically, the present invention relates to a lid capable of forming an air-tight and water-tight seal for a container.

BACKGROUND OF THE INVENTION

Containers usually come with a cover or lid. Some containers for stuff that needs to be kept fresh, such as food, have a lid that can form an air-tight and/or water-tight seal with the container. Such a seal can be achieved by a friction-fit lid. However, both the closing and opening of the lid are difficult due to the tight friction between the lid and the container wall. Another way to seal a container with a sealable lid is to use latches. However, the use of latches adds to the production cost of the lid, and latches are often easily broken.

U.S. Pat. No. 3,750,822 provides a closure for containers, and more particularly for jars, bottles, cans and the like. The closure includes a seal pressing against the inner wall of the container, in which the sealing pressure may be quickly and reliably produced and relieved, thereby making possible a quick operation of the closure.

EP 20080461 discloses a cover for a storage container, comprising a button movably carried by the cover and a seal carried by the cover and shiftable between a compressed condition for sealingly engaging the wall structure of the container when the cover is disposed in the closed position, and an uncompressed condition for disengaging from the wall structure.

Some container lids need to be cleaned from time to time, especially those for storing foods. Due to the structures of existing container lids including those lids disclosed in U.S. Pat. No. 3,750,822 and EP 20080461, it is difficult to clean the inside of the lids as it is very difficult, if not impossible, to disassemble the lids without causing damages to them.

Therefore, there is a need for a sealable container lid which can be easily attached to and removed from the container, and which has a simple structure. There is also a need for a container lid that can be easily disassembled and re-assembled for cleaning purpose.

SUMMARY OF THE INVENTION

The present invention has been developed to fulfill the needs noted above and therefore has a principle object of the provision of a container lid which is structurally simplified but creates the air-tight and fluid-tight seal for the container.

Another object of the invention is to provide a container lid which provides the ease and convenience of disassembling all the parts thereof for cleaning operation.

A yet object of the invention is to provide a sealing ring adapted for use with the container lid to provide the better sealing effect. These and other objects and advantages of the invention are satisfied by providing a container lid according to the present invention, which comprises:

a lid body having a receiving chamber and a hollow barrel extending downwardly from a bottom of the receiving chamber;

a handle assembly having a handle received in the receiving chamber of the lid body, said handle having a undercut portion formed thereon; and a neck member projecting downwardly from a bottom of the handle and displaceable between a first position where the neck member is engaged with a first section of the hollow barrel of the lid body and a second position where the neck member is engaged with or disengaged from a second section of the hollow barrel of the lid body, and the neck member having a passage formed therethrough for a locking device to pass through;

at least one locking plate recessed in the undercut portion of the handle and having a window formed therethrough for the locking device to pass through to be restrained in the locking plate when the neck member of the handle assembly is in the first position and to be releasable from the locking plate when the neck member of the handle assembly is in the second position;

a base plate having a central hub member extending from a top surface thereof and engageable with the locking device and detachably coupled to the lid body; and a sealing ring provided between the lid body and the base plate, said sealing ring being biased against an inner wall of the container to create a seal between the lid and the container when the neck member of the handle assembly is in the first position, and moving away from the inner wall of the container to allow removal of the lid from the container when the neck member of the handle assembly is in the second position.

Preferably, the hollow barrel has internal threads for mating engagement with corresponding threads formed on an outside of the neck member of the handle assembly.

In one embodiment of the present invention, the handle assembly further comprises two opposite tabs extending downwardly from a free end of the neck member; and a rotation stopper secured to the lid body is provided and has an opening formed through the rotation stopper, and two opposite blocks extend inwardly from an inner wall surface of the opening to prevent the respective tabs and thus in turn the handle assembly from further movement after the handle assembly is actuated to move to a predetermined position. For example, the handle assembly may be actuated to rotate by an angle in the range of 0 to 90 degrees.

In one embodiment of the present invention, a protrusion may be formed on the inner wall surface of the opening at each of two sides separated by the two blocks, so that application of force on the handle assembly is required to enable the respective tab to override the protrusion, thereby allowing the handle assembly to move.

In another preferred embodiment of the present invention, the threaded outside of the neck member has a plurality of longitudinal grooves, and a pair of hooks secured to the lid body are provided, each hook having a hook head engagable with one of the plurality of longitudinal grooves and movable from the one groove to the other by application of rotatory force on the handle assembly, thereby allowing the handle assembly to move.

In one preferred embodiment of the present invention, the lid may comprise two locking plates having a respective window for allowing the locking device to pass therethrough, said two locking plates are superimposed over each other facing in opposite directions in a manner that one of the locking plates is slidable horizontally with respect to the other, and the superimposed windows of the two locking plates are sized and shaped to permit the upper locking plate to restrain the locking device therein when the two locking plates are held in place, and the superimposed windows vary in size and shape to permit the releasing of the locking device when the two locking plates are forced to move in approximation with each other.

Preferably, the upper locking plate is shorter in length than the lower locking plate, the two locking plates being in alignment on one side and spaced apart in a distance on the opposite side; and a resilient element is provided to hold them in place. In one embodiment of the invention, the resilient element is formed as a spring disposed in the spacing defined by the two locking plates, with two ends of the spring connecting the two locking plates to hold them in place. A respective spring holder may be provided in the two locking plates to hold at least one part of the spring respectively. A bulge may be formed on the side of the lower locking plate opposite to the spring and abuts against an inner wall surface of the window of the upper locking plate.

In another embodiment of the invention, the resilient element is formed in the form of a resilient member for each of the locking plates, the resilient member having one end fixed to the locking plate and the other end being in abutment with an inner wall of the undercut portion of the handle so as to hold the two locking plates in place.

In a preferred embodiment of the present invention, at least one slide knob extend vertically from the respective locking plate, and the two locking plates are actuated to move in approximation with each other by pushing the slide knobs inwardly.

In another embodiment of the present invention, the locking device comprises a locking stud having a stud body provided with a cavity and having a flange on a top of the body, said stud body being engageable with the central hub member of the base plate, said flange being sized and shaped to cooperate with the window of the locking plate to enable the restraint and releasing of the locking device; a pressing rod, at least a part of the pressing rod being mounted within the cavity of the stud body; and a spring member retained within the central hub member of the base plate and attached to a free end of the pressing rod. Preferably, the central hub member has internal threads for mating engagement with corresponding threads formed on an outside of the stud body.

A handle cap may be provided to cover the handle assembly.

A second aspect of the present invention provides a sealing ring which has a cross section comprising a horizontal part, a first oblique part extending upwardly and outwardly from the horizontal part, a second oblique part extending upwardly and inwardly from the first oblique part, and a vertical part extending upwardly from the second oblique part. Preferably, the vertical part is made of a plastic material and the other three parts are made of silicon.

In one embodiment, a strengthening ring is provided on the lid body and of flute configuration for insertion of a top portion of the vertical part of the sealing ring to create a better sealing effect. Preferably, the strengthening ring has a first extension and a second extension extending from two opposite side walls of the flute, the first extension extends outwardly such that it is intimately in abutment against the lid body and the container, and the second extension extends inwardly such that it is in abutment with the bottom of the lid body.

In one embodiment, the horizontal part of the sealing ring is attached to a peripheral edge of the base plate with glue.

In another preferred embodiment, a plurality of apertures are formed on the horizontal part of the sealing ring, and a plurality of bulges are provided perimetrically on the base plate, such that the plurality of bulges extend through the plurality of apertures to thereby form a lock therebetween.

A third aspect of the present invention provides a container comprising a housing including an open-top wall structure defining a receptacle for receiving a material to be store, and a lid according to the present invention.

Other objects, features and advantages of the invention will be apparent from the following detailed disclosure, taken in conjunction with the accompanying drawings, wherein like numerals refer to like parts, elements, components, steps and processes.

DETAILED DESCRIPTION OF EMBODIMENTS

While this invention is illustrated and described in preferred embodiments, the container lid and the sealing ring may be produced in many different configurations, sizes, forms and materials.

Figure 1:
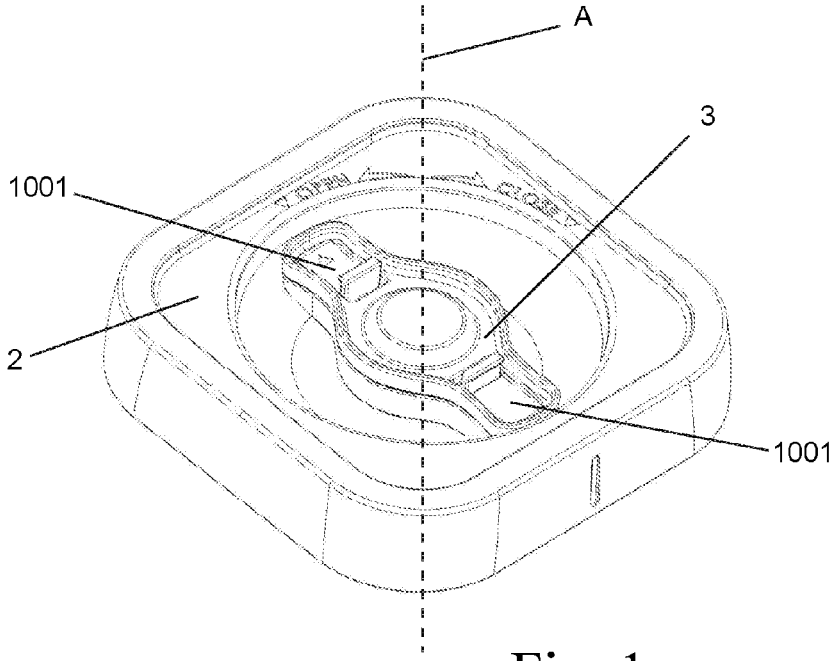
FIG. 1 is a perspective view of a sealable lid constructed according to a preferred embodiment of the present invention.
Figure 2:
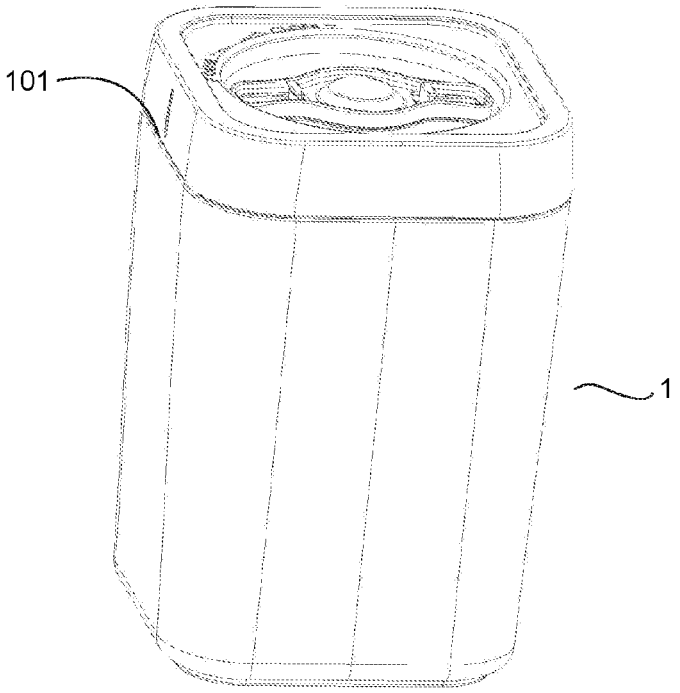
FIG. 2 is a perspective view of the sealable lid shown in FIG. 1 placed over the container.

Referring now to the drawings, FIG. 1 illustrates a sealable lid for a container constructed according to a preferred embodiment of the present invention. The sealable lid comprises a lid body 2 and a handle assembly 3. The handle assembly 3 can be rotated around an axis A in order to seal or unseal the container. FIG. 2 illustrated the sealable lid according to the present invention attached to a container 1, which is substantially in the shape of a cuboid. The lid has a shape and size corresponding to an opening 101 defined by the top of the container 1. The lid is loosely seated in the opening 101 of the container 1. To seal the lid and the container 1 together, a user rotates the handle assembly 3 around an axis A from a second position to a first position. Rotating the handle assembly 3 causes a sealing ring 7 (FIG. 3) inside the lid to expand and form a seal between the lid and the container 1. The sealing ring 7 between the lid and the container 1 helps to preserve items, such as food items, stored in the container 1. To remove the item stored in the container 1, the user rotates the handle assembly 3 back to the second position to release the sealing ring 7, causing the sealing ring 7 to return to its original non-compressed form, and thereby release the lid from the container 1. The user now is able to easily remove the lid from the container 1 to access the contents of the container.

The lid therefore allows a user to easily and quickly seal a container and alternatively to release the seal and remove contents from the container 1. The illustrated embodiment shows the lid and the container 1 having a particular size and shape. However, it should be appreciated that the lid and the container 1 may have any suitable sizes and/or shapes to accommodate different storage items.

Figure 3:
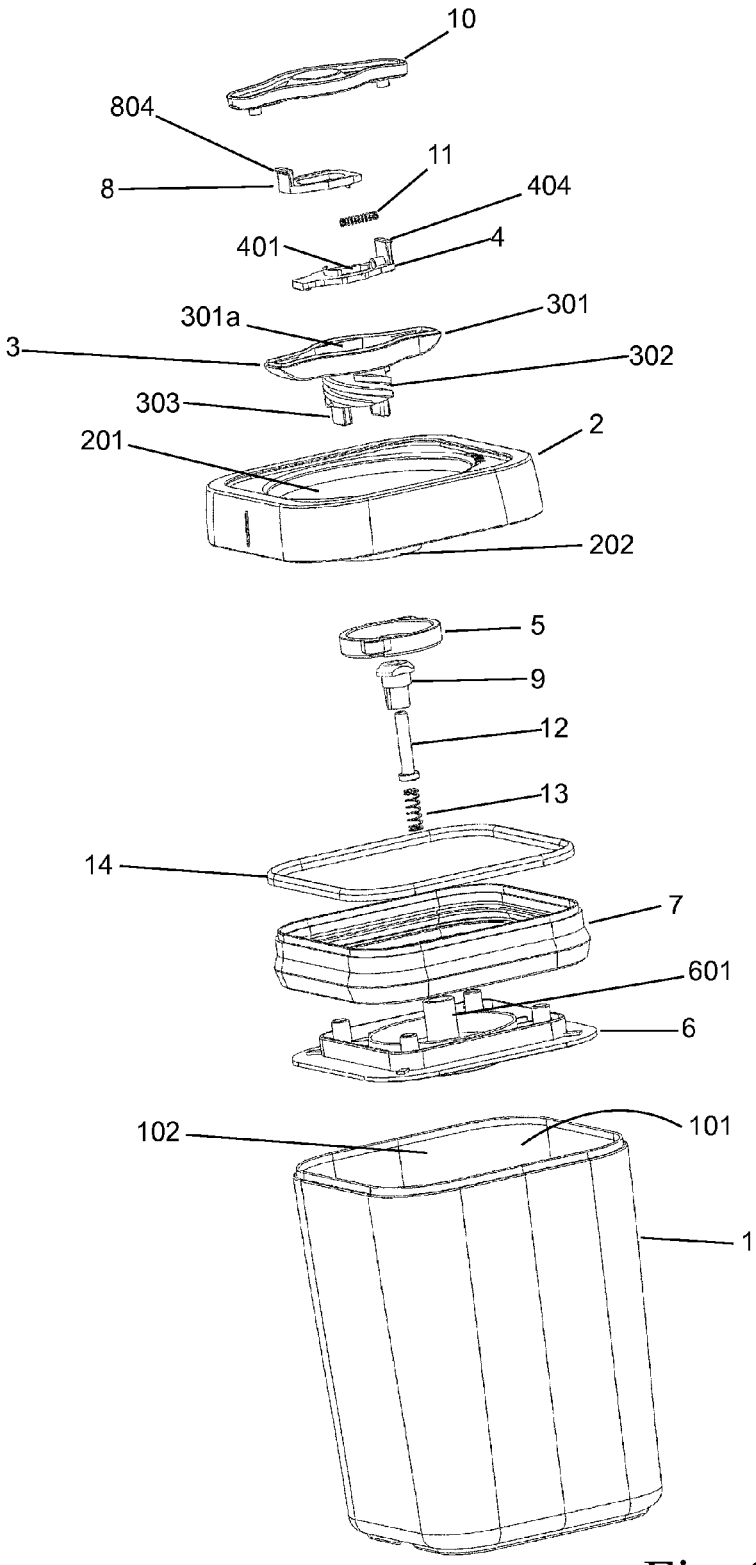
FIG. 3 is an exploded perspective view of the sealable lid and the container shown in FIG. 2.
Figure 4:
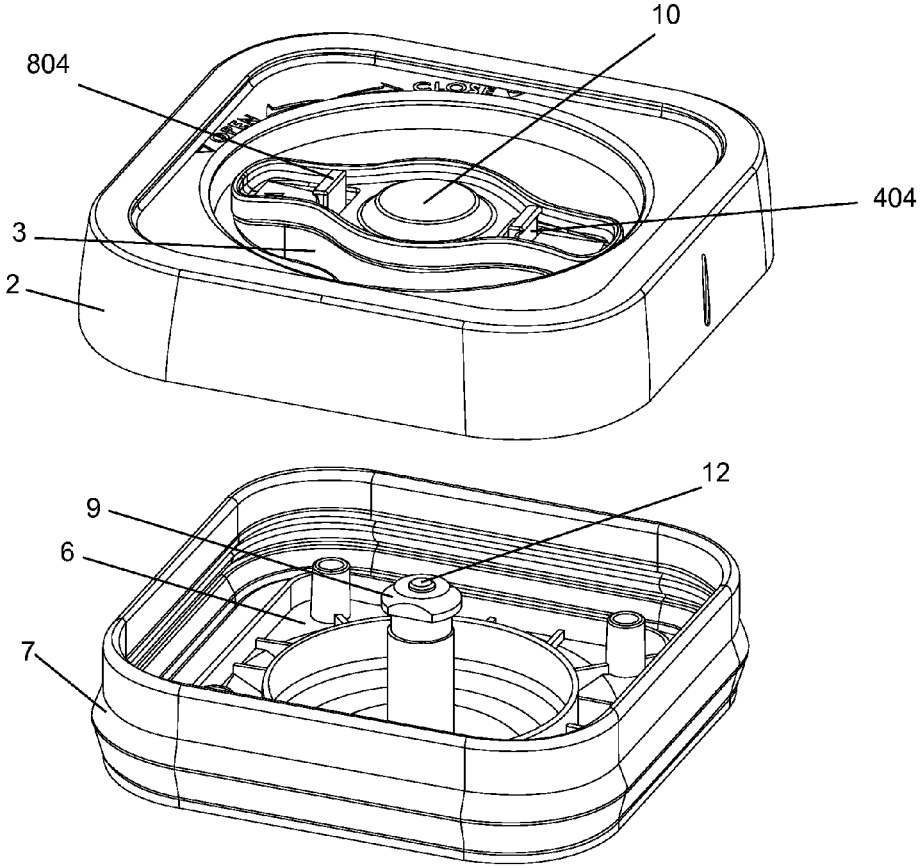
FIG. 4 is a perspective view of the sealable lid shown in FIG. 1 illustrating the lid is disassembled into a lid body and a base plate with the sealing ring.

Referring to FIGS. 3 and 4, the lid comprises a lid body 2, which has a receiving chamber 201 and a hollow barrel 202 extending downwardly from the bottom of the receiving chamber 201. The hollow barrel 202 is preferably cylindrical and has internal threads formed on its inner surface. On top of the lid body 2 there is a handle assembly 3, which comprises a handle assembly 301 and a neck member 302 projecting downwardly from the bottom of the handle assembly 301. The handle assembly 301 has an undercut portion 301*a* and is received in the receiving chamber 201 of the lid body 2. Corresponding to the shape of the hollow barrel 202 of the lid body 2, the neck member 302 is also preferably cylindrical and has outer threads on its outer surface, said outer threads cooperating with the inner threads on the inner surface of the hollow barrel 202 of the lid body 2. The neck member 302 is displaceable between a first position where the neck member is engaged with a first section of the hollow barrel of the lid body and a second position where the neck member is engaged with or disengaged from a second section of the hollow barrel of the lid body. A vertical passage 302*a* is provided through the handle assembly 301 and the neck member 302. Extending downwardly from the neck member 302 are two tabs 303, placed opposite to each other on the circumference of the neck member 302.

Figure 5:
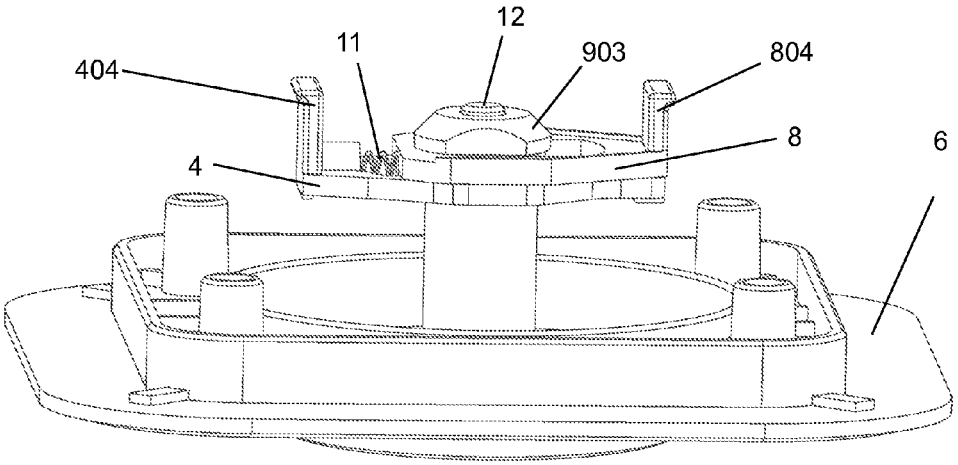
FIG. 5 is a perspective view of a base plate with the locking mechanism.
Figure 6:
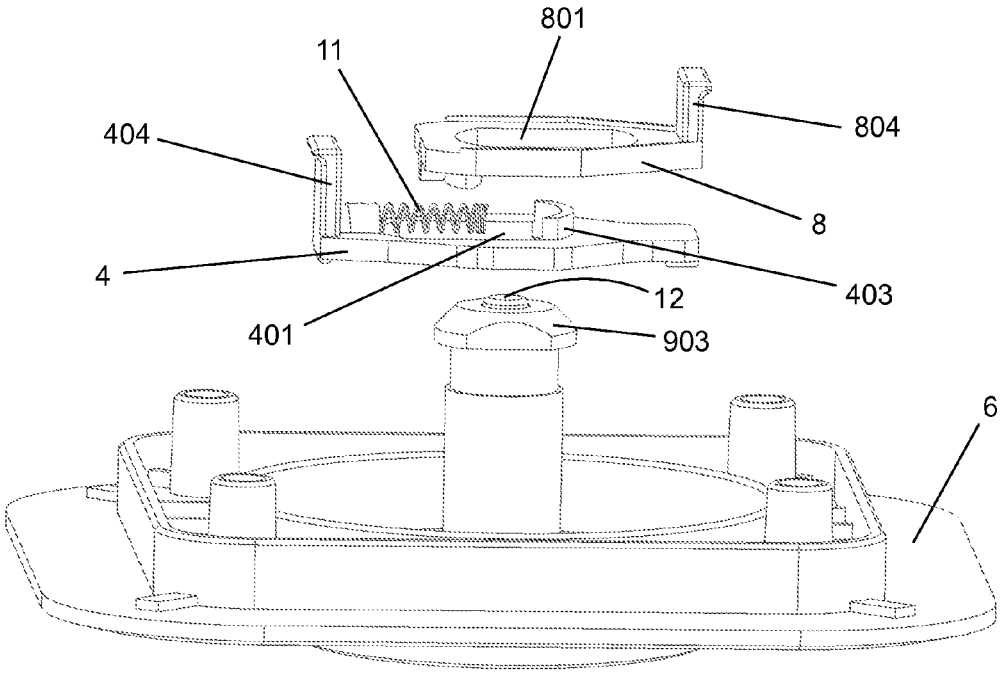
FIG. 6 is an exploded perspective view of the base plate with the locking mechanism.
Figure 7:
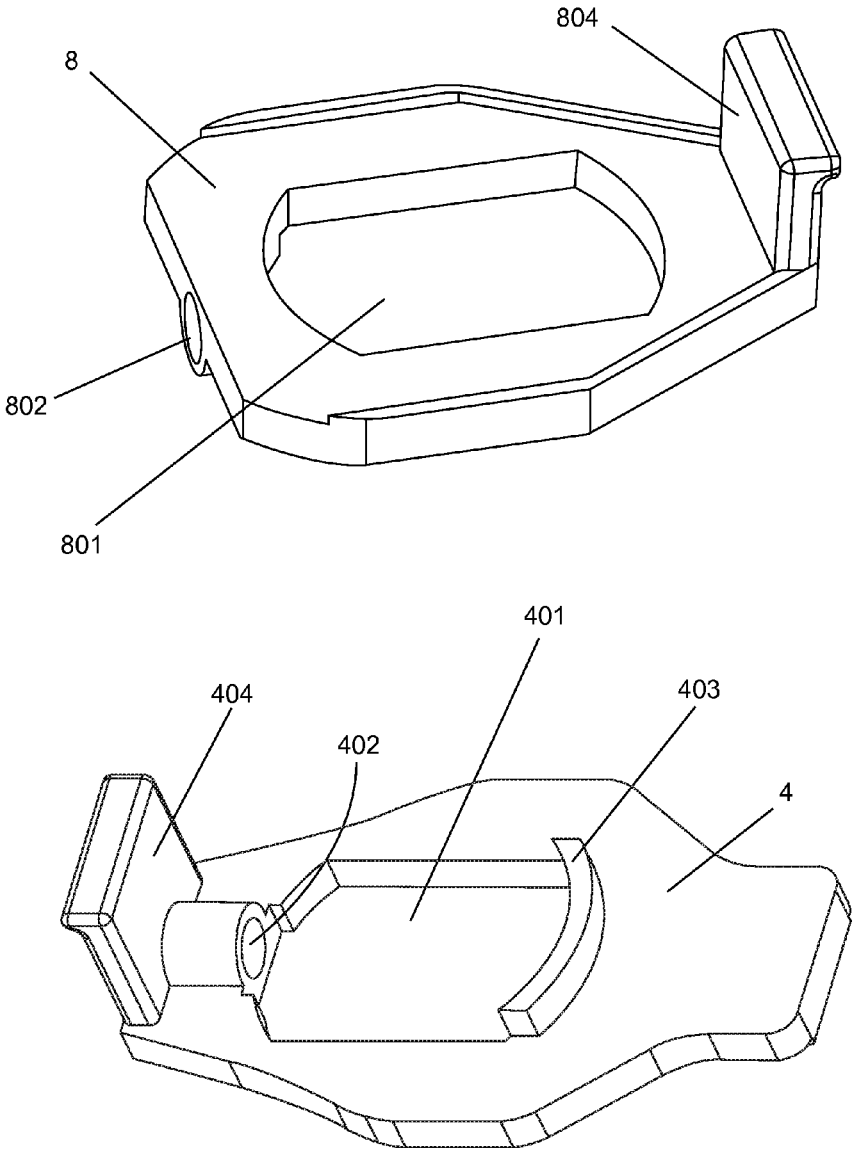
FIG. 7 is a perspective view of a pair of locking plates constructed according to the present invention.

Now referring to FIGS. 3, 5 and 6, two locking plates 4 and 8 are recessed in the undercut portion 301*a* of the handle assembly 301, one above the other. Each of the locking plates 4 and 8 has a window 401 and 801 formed therethrough in line with the hollow barrel 202 of the lid body 2 and the passage 302*a* in the neck member 302 and the handle assembly 301. Each of the windows 401 and 801 in the locking plates 4 and 8, as shown in FIG. 7, has two parallel straight edges and two opposite curved edges. A bulge 403 is formed on one of the curved edges of the window 401 in the locking plate 4. A first spring 11 is provided horizontally between the two locking plates 4 and 8. A spring holder 402, 802 (see FIG. 7) is formed respectively on each of the locking plates 4 and 8 to accommodate the first spring 11. A slide knob 404, 804 is formed on each of the locking plates 4 and 8, which is pushed inwardly to actuate to move the locking plates 4 and 8 to move in approximation with each other.

Figure 8:
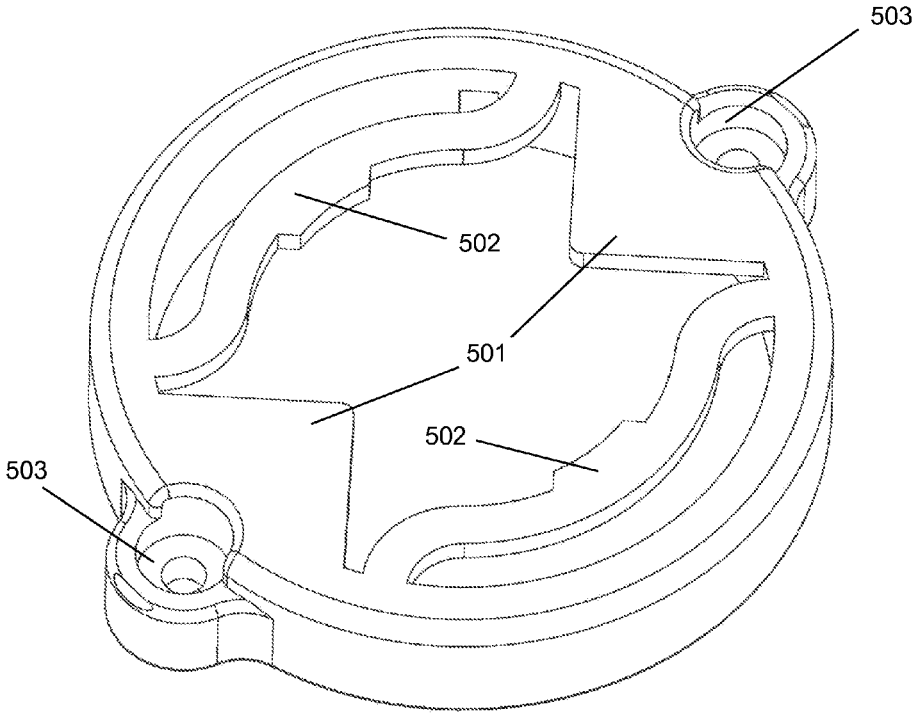
FIG. 8 is a perspective view of a rotation stopper constructed according to the present invention.

Still referring to FIG. 3, a handle cap 10 is provided on top of the locking plates 4 and 8 and secured to the handle assembly 301 through common methods such as clamps. Two rectangular holes 1001 (see FIG. 1) are formed in the handle cap 10 for the slide knobs 404 and 804 to extend through and slide therein. Below the lid body 2, there is a rotation stopper 5, the shape of which is shown in FIG. 8. The rotation stopper 5 has an opening therethrough, and two blocks 501 extend inwardly opposite to each other from the inner wall surface of the opening of the rotation stopper 5. The blocks 501 prevent the tabs 303 and thus in turn the handle assembly 3 from further movement after the handle assembly 3 is actuated to move to a predetermined position. In other words, the blocks 501 in cooperation with the tabs 303 limit the rotation of the handle assembly 3 by a range of 0 to 90 degrees. Furthermore, a protrusion 502 is formed on the inner wall surface of the opening at each of two sides separated by the two blocks 501, so that application of force on the handle assembly 3 is required to enable the respective tab to override the protrusion 502, thereby allowing the handle assembly 3 to move. The rotation stopper 5 is secured to the bottom of the lid body 2 through screwing device 503.

Figure 13:
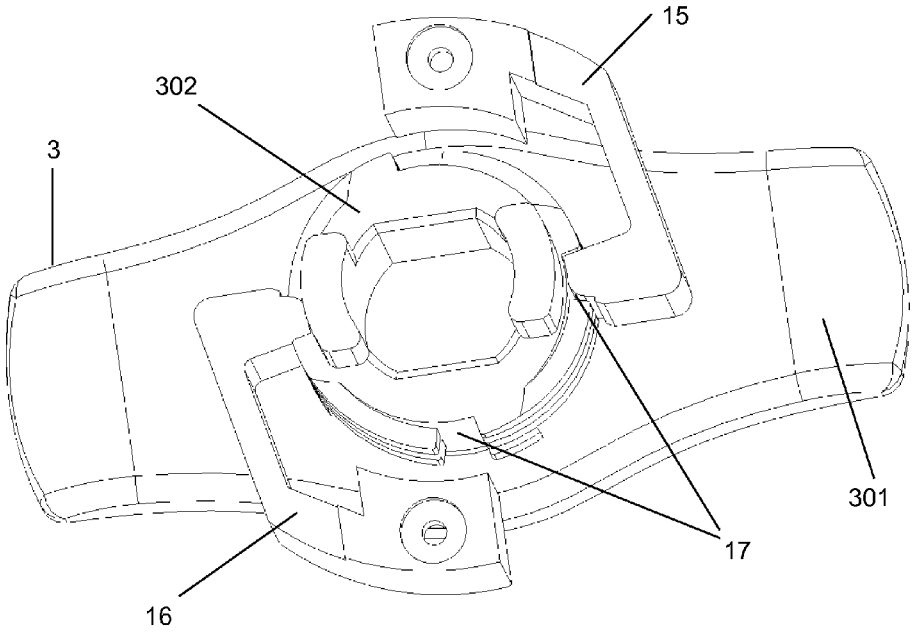
FIG. 13 is a perspective view of a pair of hooks engaged with longitudinal grooves on the threaded outside of the neck member of the handle assembly according to a preferred embodiment of the present invention.
Figure 14:
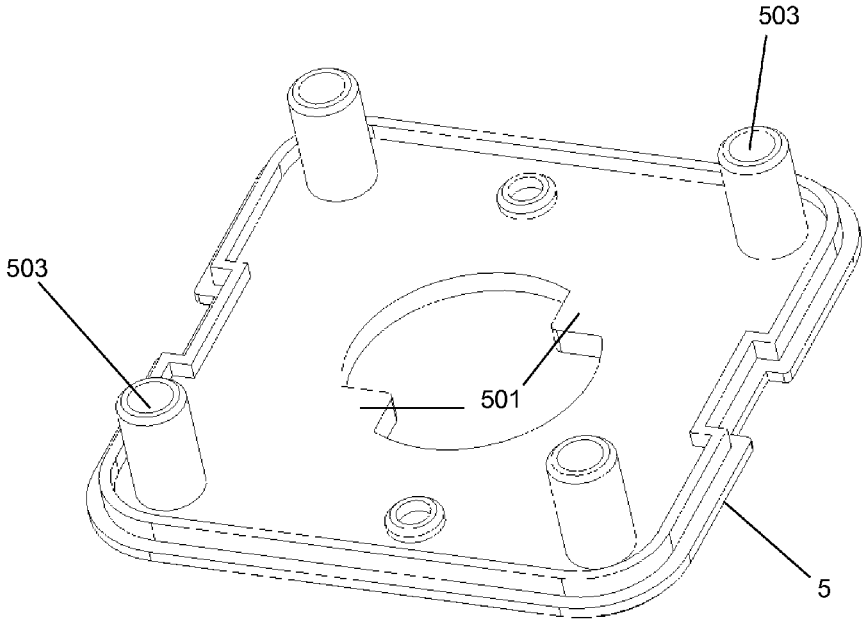
FIG. 14 is a perspective view of a rotation stopper constructed according to an embodiment of the present invention.

Alternatively, as shown in FIG. 13, the threaded outside of the neck member 302 has a plurality of longitudinal grooves 17, and a pair of hooks 15, 16 secured to the lid body 2 are provided, each hook having a hook head engagable with one of the plurality of longitudinal grooves 17 and movable from the one groove to the other by application of rotatory force on the handle assembly 3, thereby allowing the handle assembly 3 to move. As shown in FIG. 14, the rotation stopper with the blocks 501 can also be provided in the form of a rectangular cover, which is secured to the bottom of the lid body 2 through screwing device 503.

Figure 10:
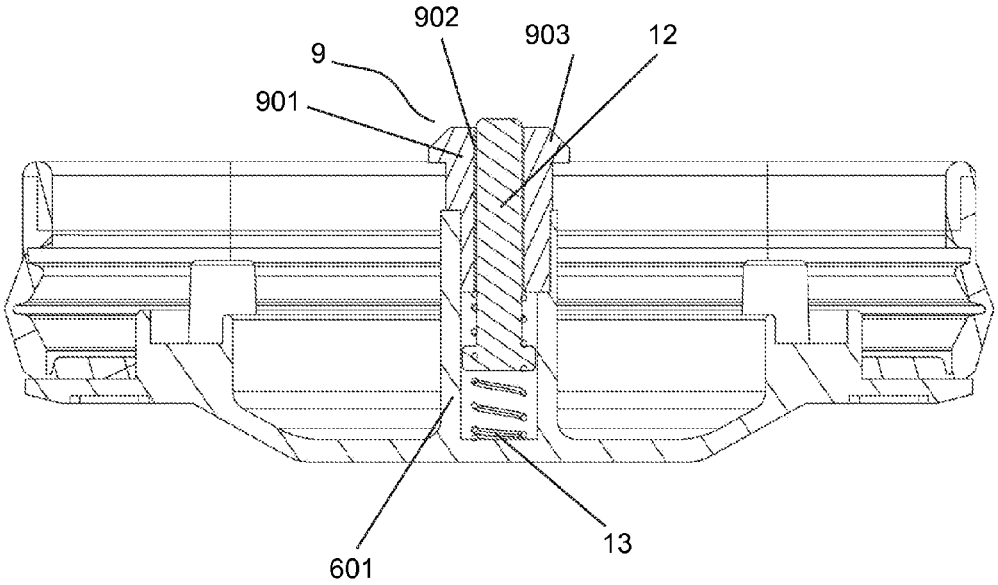
FIG. 10 is a cross sectional view of the base plate.

At the bottom of the lid is a base plate 6, on the top surface of which there is formed a central hub member 601 (see FIG. 10), which has inner threads on its inner surface. Placed inside the central hub member 601 sequentially from bottom to top are a second spring 13, a pressing rod 12 and a locking stud 9. The locking stud 9 has a stud body 901 provided with a cavity 902, and a flange 903 on top of the stud body 901. The stud body 901 has threads on its outside surface, and is secured to the central hub member 601 through mating engagement with corresponding threads formed inside the central hub member 601. The pressing rod 12 extends through the cavity 902 and is able to slide vertically relative to the locking stud 9. The pressing rod 12 further comprises a widened bottom which presses against the second spring 13 and which limits itself within the central hub member 601. The locking stud 9 extends through the hollow barrel 202 of the lid body 2, the passage 302*a* in the neck member 302 of the handle assembly 3 and the windows 401 and 801 of the locking plates 4 and 8. In the original state, the flange 903 of the locking stud 9 rests on the locking plates 4 and 8. Thus, the base plate 6 is coupled to the handle assembly 3.

Figure 9A:
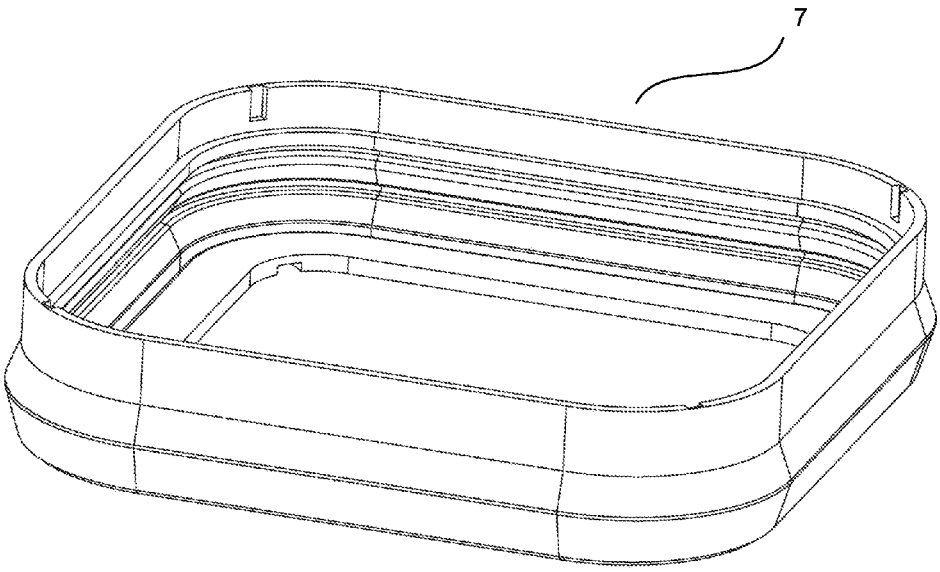
FIG. 9A is a perspective view of a sealing ring constructed according to a preferred embodiment of the present invention.
Figure 9B:
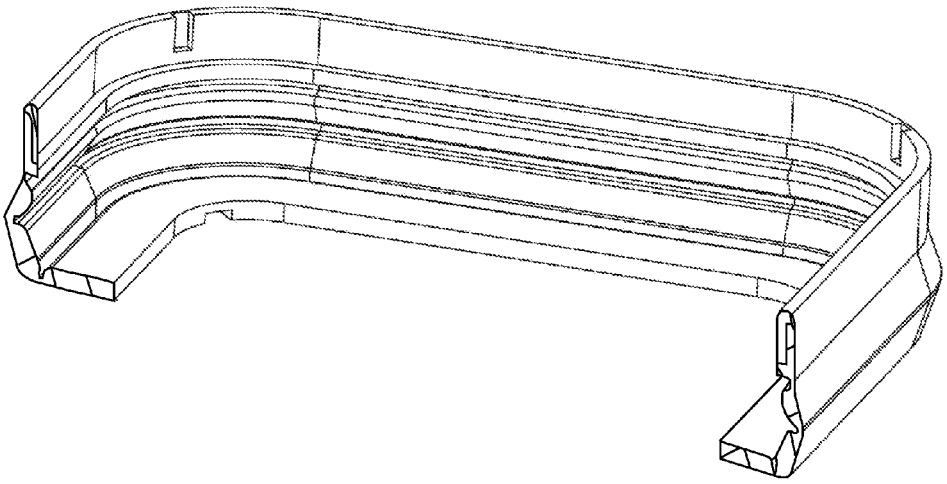
FIG. 9B is a perspective view in cross-section of the sealing ring taken along line I-I of FIG. 9A.
Figure 12:
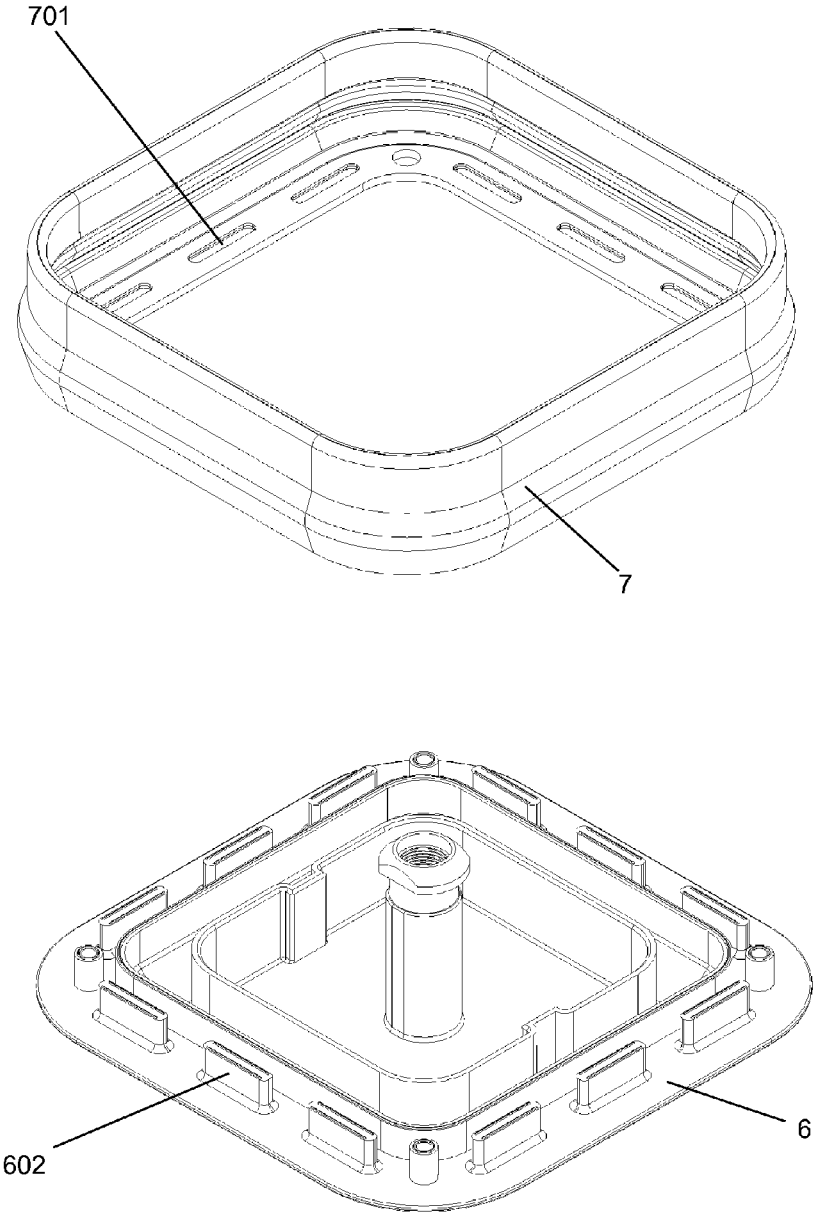
FIG. 12 is a perspective view of a sealing ring with apertures formed in the horizontal part and a base plate with corresponding bulges provided on its peripheral edge according to a preferred embodiment of the present invention.

A sealing ring 7 is provided between the lid body 2 and the base plate 6. The shape of the sealing ring 7 is shown in FIG. 9. The cross section of the sealing ring 7 comprises a horizontal part, a first oblique part extending upwardly and outwardly from an end of the horizontal part, a second oblique part in continuation of the first oblique part, said second oblique part extending upwardly and inwardly, and a vertical part in continuation of the second oblique part and extending upwardly. The vertical part is preferably made of plastics, so that the sealing ring 7 can be easily attached to the lid body 2 by inserting the vertical part into an annular slot formed on the edge of the lid body 2. The horizontal part is secured to the edge of the base plate 6 through common methods such as adhesive bonding. Alternatively, as shown in FIG. 12, a plurality of apertures 701 are formed on the horizontal part of the sealing ring 7, and a plurality of bulges 602 are provided perimetrically on the base plate 6, such that the plurality of bulges 602 extend through the plurality of apertures 701 to thereby form a lock therebetween. Preferably, a strengthening ring 14 is provided on the lid body 2 and of flute configuration for insertion of a top portion of the vertical part of the sealing ring 7 to create a better sealing effect. More preferably, the strengthening ring 14 has a first extension and a second extension extending from two opposite side walls of the flute, the first extension extends outwardly such that it is intimately in abutment against the lid body and the container, and the second extension extends inwardly such that it is in abutment with the bottom of the lid body.

Figure 11A:
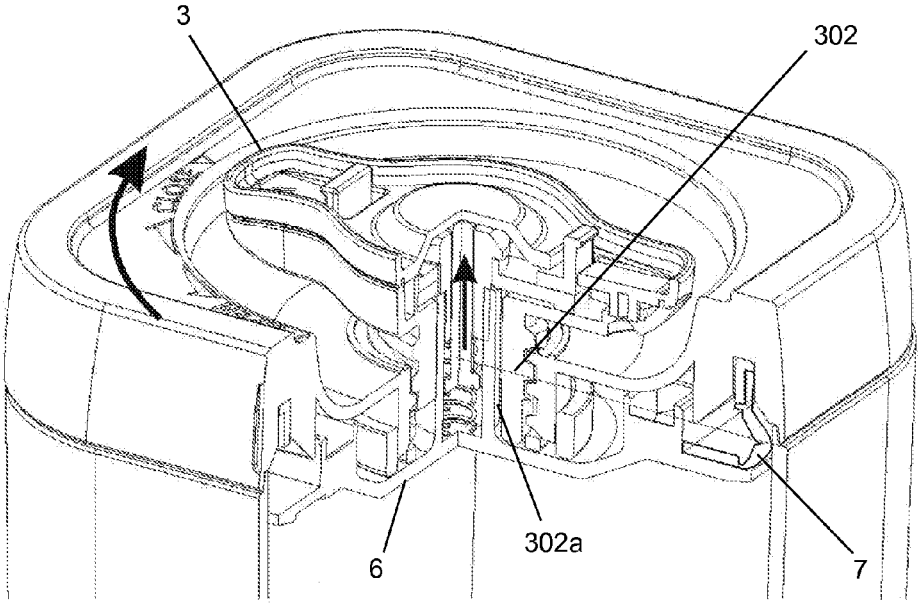
FIG. 11A is a perspective view of the sealable lid with a part thereof being removed.
Figure 11B:
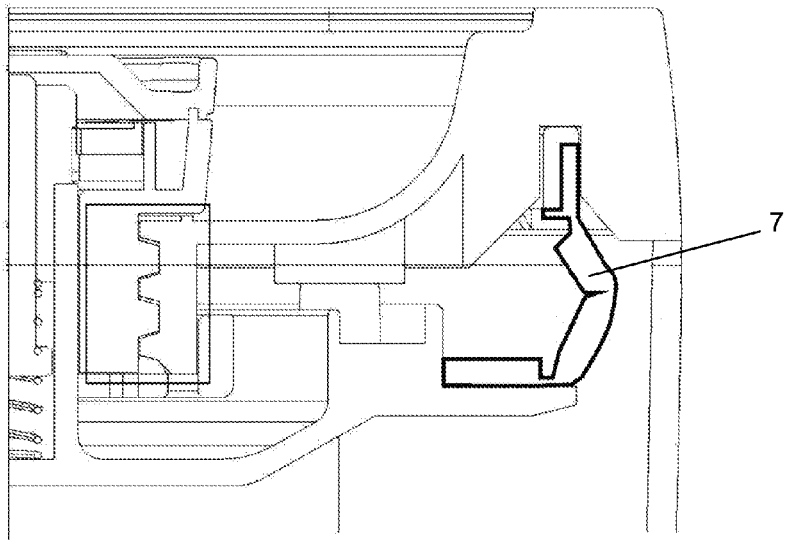
FIG. 11B is a cross-sectional view of the sealing ring in an unsealed state.
Figure 11C:
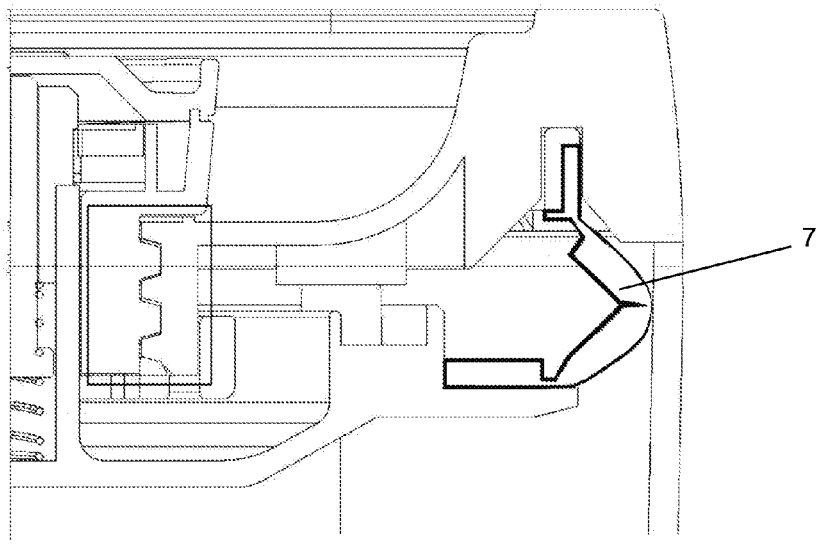
FIG. 11C is a cross-sectional view of the sealing ring in a sealed state.

Referring to FIGS. 11A to 11C, the mechanism of sealing the container 1 by rotating the handle assembly 3 of the lid according to the present invention will now be elaborated. When the user wants to place and seal the lid over the container 1, he rotates the handle assembly 3 around axis A from the second position to the first position. Through the interaction between the outer threads of the neck member 302 of the handle assembly 3 and the inner threads of the hollow barrel 202 of the lid body 2, the handle assembly 3 is lifted relative to the lid body 2. As a result, because the base plate 6 is coupled to the handle assembly 3 as described above, the base plate 6 is also lifted, that is, brought towards the lid body 2, compressing the sealing ring 7, which is forced to bias towards and press against the wall 102 of the container 1, thereby sealing the container (FIG. 11C). The container 1 can also be easily detached from the lid by simply rotating the handle assembly 3 back to the second position, which lowers the base plate 6, releasing the sealing ring 7 to its un-compressed state (FIG. 11B). In the un-compressed state, the sealing ring 7 stays away at a small distance from the wall 102 of the container 1, therefore allowing the lid to be removed from the container 1 with little effort.

In addition to the ease of sealing and opening the container, the lid of the present invention has a further advantage of easy disassembly. Referring to FIG. 4, the lid can be disassembled into two parts by simply pushing the two slide knobs 404 and 804 towards each other. This function is a result of the design of the shapes of the windows 401 and 801 in the locking plates 4 and 8, as well as the shape of the flange 903 of the locking stud 9 (see FIG. 5 and FIG. 6). The windows 401 and 801 in the locking plates 4 and 8 are only partially superimposed, and their relative positions define the superimposed area of the windows 401 and 801. In the original state, the superimposed area is smaller than the size of the flange 903 of the locking stud 9, which is the reason why the flange 903 of the locking stud 9 can rest on the locking plates 4 and 8, coupling the base plate 6 to the handle assembly 3. When the two slide knobs 404 and 804 are pushed towards each other, the superimposed area of the windows 401 and 801 becomes larger than the flange 903 of the locking stud 9, allowing the locking stud 9 to be released from the handle assembly 3, and therefore allowing the base plate 6 and the sealing ring 7 to be detached from the lid body 2.

As described above, a first spring 11 is provided between the locking plates 4 and 8, pushing them away from each other all the time. This feature ensures that when the slide knobs 404 and 804 are not forced to come towards each other (that is, when there is no intention to disassemble the lid 101), the flange of the locking stud 9 is safely kept above the locking plates 4 and 8 and the base plate 6 is safely coupled to the handle assembly 3 and the lid body 2. Also, when the user wants to re-assemble the lid 101, the first spring 11 makes it possible to attach the base plate 6 to the lid body 2 by simply forcing the locking stud 9 upwardly through the windows 401 and 801 of the locking plates 4 and 8. It should be noted that instead of a spring, any other suitable resilient means can be used to maintain the locking plates 4 and 8 to their original positions in place. For example, a tail-shaped resilient member can be formed integrally on each of the locking plates 4 and 8 and in abutment with the inner wall of the undercut portion 301*a* of the handle 301 to play the same role as the first spring 11.

Still another advantage of the lid of the present invention is that it can be disassembled only after the lid is removed from the container 102, that is, only after the handle assembly 3 is rotated to the second position. This is a result of the shapes of the windows 401 and 801 of the locking plates 4 and 8 and the flange 903 of the locking stud 9. With the handle assembly 3 in the second position, when the slide knobs 404 and 804 are pushed towards each other, the length of the superimposed area of the windows 401 and 801 of the locking plates 4 and 8 is increased in the direction parallel to the long edge of the flange 903 of the locking stud 9, therefore allowing said flange 903 to be released. When the handle is in the first position, said superimposed area is elongated in a direction orthogonal to the long edge of the flange 903 of the locking stud 9 and is sized to restrain the flange 903, therefore said flange 903 will not be released. This feature reduces the possibility of unintentional disassembling of the lid.

The second spring 13 in a compressed state applies an upwardly pushing force on the pressing rod 12, which in turn presses against the handle cap 10. As a result, when the lid is assembled, there is a constant downward pressure from the handle cap 10 applied on the pressing rod 12, which in turn applies a downward pressure on the second spring 13 and the base plate 6. This constant downward pressure facilitates the detachment of the base plate 6 from the lid body 2 when the locking stud 9 is released from the handle assembly 3. Besides, as the locking stud 9 is secured to the base plate 6 through the threads in the central hub member 601, a constant downward force is also applied on the locking stud 9, increasing the pressure between the flange 903 of the locking stud 9 and the bearing locking plates 4 and 8, which enforces the locking effect and makes the whole structure more stable.

Although two locking plates are provided in the above described embodiment, it is conceivable that one or more than two locking plates can be provided for the same purpose of the two locking plates described above.

In the embodiment described above, the components of the lid and the container are preferably made of a polymer or plastic which can be washed and stored. Preferably, the locking plates 4 and 8, the neck member 302 and the rotation stopper 5 are made of polyoxymethylene (POM), while the handle cap 10, the handle assembly 3, the lid body 2, the locking stud 9, the pressing rod 12 and the base plate 6 are made of acrylonitrile butadiene styrene (ABS). It should be appreciated however that the lid and the other components of the container may be made of any suitable material or materials. It should also be appreciated that the components of the container may be connected or manufactured in any suitable order other than that described above.

While the present invention is described in connection with what is presently considered to be the most practical and preferred embodiment, it should be appreciated that the invention is not limited to the disclosed embodiment, and is intended to cover various modifications and equivalent arrangements included within the spirit and scope of the claims. Modifications and variations in the present invention may be made without departing from the novel aspects of the invention as defined in the claims, and this application is limited only by the scope of the claims.

NUMERICAL REFERENCES

1 container
101 opening
102 inner wall
2 lid body
201 receiving chamber
202 hollow barrel
3 handle assembly
301 handle
301*a* undercut portion
302 neck member
302*a* passage
303 tab
4 locking plate
401 window
402 spring holder
403 bulge
404 slide knob
5 rotation stopper
501 block
502 protrusion
503 screwing device
6 base plate
601 central hub member
602 bulge
7 sealing ring
701 aperture
8 locking plate
801 window
802 spring holder
804 slide knob
9 locking stud
901 stud body
902 cavity
903 flange
10 handle cap
1001 hole
11 first spring
12 pressing rod
13 second spring
14 strengthening ring
15 hook
16 hook
17 groove
A axis

What is claimed is:

1. A lid for a container (1), comprising: a lid body (2) having a receiving chamber (201) and a hollow barrel (202) extending downwardly from a bottom of the receiving chamber (201); a handle assembly (3) having a handle (301) received in the receiving chamber (201) of the lid body (2), said handle (301) having a undercut portion (301*a*) formed thereon; and a neck member (302) projecting downwardly from a bottom of the handle (301) and displaceable between a first position where the neck member is engaged with a first section of the hollow barrel of the lid body and a second position where the neck member is engaged with a second section of the hollow barrel of the lid body, and the neck member (302) having a passage (302*a*) formed therethrough for a locking means to pass through;

at least one locking plate (4) recessed in the undercut portion (301*a*) of the handle (301) and having a window (401) formed therethrough for the locking device to pass through to be restrained in the locking plate (4) when the neck member (302) of the handle assembly (3) is in the first position and to be releasable from the locking plate (401) when the neck member (302) of the handle assembly (3) is in the second position;

a base plate (6) having a central hub member (601) extending from a top surface thereof and engageable with the locking device and detachably coupled to the lid body (2); and a sealing ring (7) provided between the lid body (2) and the base plate (6), said sealing ring (7) being biased against an inner wall (102) of the container (1) to create a seal between the lid and the container (1) when the neck member (302) of the handle assembly (3) is in the first position, and moving away from the inner wall (102) of the container (1) to allow removal of the lid from the container (1) when the neck member (302) of the handle assembly (3) is in the second position.

2. The lid as claimed in claim 1, wherein the hollow barrel (202) has internal threads for mating engagement with corresponding threads formed on an outside of the neck member (302) of the handle assembly (3).

3. The lid as claimed in claim 1, wherein the neck member (302) further comprises two opposite tabs (303) extending downwardly from a free end of the neck member (302); and a rotation stopper (5) secured to the lid body (2) is provided and has an opening formed through the rotation stopper (5), and two opposite blocks (501) extend inwardly from an inner wall surface of the opening to prevent the respective tabs (303) and thus in turn the handle assembly (3) from further movement after the handle assembly (3) is actuated to move to a predetermined position.

4. The lid as claimed in claim 3, wherein a protrusion (502) is formed on the inner wall surface of the opening at each of two sides separated by the two blocks (501), so that application of force on the handle assembly (3) is required to enable the respective tab (303) to override the protrusion (502), thereby allowing the handle assembly (3) to move.

5. The lid as claimed in claim 3, wherein the hollow barrel (202) has internal threads for mating engagement with corresponding threads formed on an outside of the neck member (302) of the handle assembly (3), and the threaded outside of the neck member (302) has a plurality of longitudinal grooves (17); and a pair of hooks (15, 16) secured to the lid body (2) are provided, each hook having a hook head engagable with one of the plurality of longitudinal grooves (17) and movable from the one groove to the other by application of rotatory force on the handle assembly (3), thereby allowing the handle assembly (3) to move.

6. The lid as claimed in claim 3, wherein the handle assembly (3) is actuated to rotate by an angle in the range of 0 to 90 degrees.

7. The lid as claimed in claim 1, wherein the lid comprises two locking plates (4, 8) having a respective window (401, 801) for allowing the locking device to pass through, said two locking plates (4, 8) are superimposed over each other facing in opposite directions in a manner that one of the locking plates is slidable horizontally with respect to the other, and the superimposed windows (401, 801) of the two locking plates (4, 8) are sized and shaped to permit the upper locking plate (8) to restrain the locking device therein when the two locking plates (4, 8) are held in place, and the superimposed windows (401, 801) vary in size and shape to permit the releasing of the locking device when the two locking plates (4, 8) are forced to move in approximation with each other.

8. The lid as claimed in claim 7, wherein the upper locking plate (8) is shorter in length than the lower locking plate (4), the two locking plates (4, 8) being in alignment on one side and spaced apart in a distance on the opposite side; and a resilient means is provided to hold them in place.

9. The lid as claimed in claim 8, wherein the resilient means is a spring (11) disposed in the spacing defined by the two locking plates (4, 8), with two ends of the spring (11) connecting the two locking plates (4, 8) to hold them in place.

10. The lid as claimed in claim 9, wherein a respective spring holder (402, 802) is provided in the two locking plates (4, 8) to hold at least one part of the spring (11) respectively.

11. The lid as claimed in claim 9, wherein a bulge (403) is formed on the side of the lower locking plate (4) opposite to the spring (11) and abuts against an inner wall surface of the window (801) of the upper locking plate (8).

12. The lid as claimed in claim 8, wherein the resilient means is in the form of a resilient member for each of the locking plates (4, 8), the resilient member having one end fixed to the locking plate (4, 8) and the other end being pressed against an inner wall of the undercut portion (301*a*) of the handle (301) so as to hold the two locking plates (4, 8) in place.

13. The lid as claimed in claim 7, wherein at least one slide knob (404, 804) extend vertically from the respective locking plate (4, 8), and the two locking plates (4, 8) are actuated to move in approximation with each other by pushing the slide knobs (404, 804) inwardly.

14. The lid as claimed in claim 1, wherein the locking device comprises a locking stud (9) having a stud body (901) provided with a cavity (902) and having a flange (903) on a top of the body, said stud body (901) being engageable with the central hub member (601) of the base plate (6), said flange (903) being sized and shaped to cooperate with the window (401, 801) of the locking plate (4, 8) to enable the restraint and releasing of the locking device; a pressing rod (12), at least a part of the pressing rod (12) being mounted within the cavity (902) of the stud body (901); and a spring member (13) retained within the central hub member (601) of the base plate (6) and attached to a free end of the pressing rod (12), and preferably the central hub member (601) has internal threads for mating engagement with corresponding threads formed on an outside of the stud body (901).

15. The lid as claimed in claim 1, wherein the sealing ring (7) has a cross section comprising a horizontal part, a first oblique part extending upwardly and outwardly from the horizontal part, a second oblique part extending upwardly and inwardly from the first oblique part, and a vertical part extending upwardly from the second oblique part, and wherein the base plate has a peripheral edge to carry the horizontal part, and the lid body is formed with an annular slot adapted for insertion of the vertical part.

16. The lid as claimed in claim 15, wherein the horizontal part of the sealing ring (7) is attached to the peripheral edge of the base plate (6) with glue.

17. The lid as claimed in claim 15, wherein a plurality of apertures (701) are formed on the horizontal part of the sealing ring (7), and a plurality of bulges (602) are provided perimetrically on the base plate (6), such that the plurality of bulges (602) extend through the plurality of apertures (701) to thereby form a lock therebetween.

18. The lid as claimed in claim 15, wherein a strengthening ring (14) is provided on the lid body (2) and of flute configuration for insertion of a top portion of the vertical part of the sealing ring (7) to create a better sealing effect.

19. The lid as claimed in claim 18, wherein the strengthening ring (14) has a first extension and a second extension extending from two opposite side walls of the flute, the first extension extends outwardly such that it is intimately in abutment against the lid body and the container, and the second extension extends inwardly such that it is in abutment with the bottom of the lid body.

20. The lid as claimed in claim 1, wherein the sealing ring (7) has a cross section comprising a horizontal part, a first oblique part extending upwardly and outwardly from the horizontal part, a second oblique part extending upwardly and inwardly from the first oblique part, and a vertical part extending upwardly from the second oblique part.

21. A container (1) comprising: a housing including an open-top wall structure defining a receptacle for receiving a material to be store; and a lid according to claim 1.

* * * * *